US011619458B2

(12) United States Patent
Dere

(10) Patent No.: US 11,619,458 B2
(45) Date of Patent: Apr. 4, 2023

(54) PRESSURE CONTROLLED INERTIA SYSTEM FOR AUTOMATIC FIRE WEAPONS

(71) Applicant: Fatih Dere, Konya (FR)

(72) Inventor: Fatih Dere, Konya (FR)

( * ) Notice: Subject to any disclaimer, the term of this patent is extended or adjusted under 35 U.S.C. 154(b) by 1 day.

(21) Appl. No.: 17/598,313

(22) PCT Filed: Nov. 11, 2020

(86) PCT No.: PCT/TR2020/051085

§ 371 (c)(1),
(2) Date: Sep. 27, 2021

(87) PCT Pub. No.: WO2021/096470

PCT Pub. Date: May 20, 2021

(65) Prior Publication Data

US 2022/0163277 A1 May 26, 2022

(30) Foreign Application Priority Data

Nov. 12, 2019 (TR) ..... 2019/17545

(51) Int. Cl.
*F41A 5/08* (2006.01)
*F41A 3/46* (2006.01)

(52) U.S. Cl.
CPC . *F41A 5/08* (2013.01); *F41A 3/46* (2013.01)

(58) Field of Classification Search
CPC ..... F41A 3/46; F41A 5/08; F41A 5/12
USPC ..... 89/182, 183
See application file for complete search history.

(56) References Cited

U.S. PATENT DOCUMENTS 2,527,895 A * 10/1950 Tassan ..... C01B 32/384 89/187.01
2,732,768 A * 1/1956 Browning ..... F41A 3/46 89/187.01
2,960,011 A * 11/1960 Bretton ..... F41A 3/66 89/182
3,901,126 A * 8/1975 Bretton ..... F41A 9/18 89/190
5,983,549 A * 11/1999 Battaglia ..... F41A 25/12 42/17

FOREIGN PATENT DOCUMENTS

EP 0281793 A2 9/1988
EP 1342974 A1 9/2003
EP 1344999 A1 9/2003

* cited by examiner

*Primary Examiner* — Bret Hayes
(74) *Attorney, Agent, or Firm* — Bayramoglu Law Offices LLC

(57) ABSTRACT

A pressure controlled inertia system for automatic fire weapons is provided. The system enabling a lock, especially in automatic rifles, to be opened by using a kinetic energy of a mechanism and a sliding handle block, wherein the kinetic energy is lost by hitting a case, after an empty cartridge is fired.

1 Claim, 12 Drawing Sheets

PRESSURE CONTROLLED INERTIA SYSTEM FOR AUTOMATIC FIRE WEAPONS

CROSS REFERENCE TO THE RELATED APPLICATIONS

This application is the national stage entry of International Application No. PCT/TR2020/051085, filed on Nov. 11, 2020, which is based upon and claims priority to Turkish Patent Application No. 2019/17545 filed on Nov. 12, 2019, the entire contents of which are incorporated herein by reference.

TECHNICAL FIELD

The invention relates to a system that enables the lock, especially in automatic rifles, to be opened by using the kinetic energy of the mechanism and sliding handle block, which is lost by hitting the case, after the empty cartridge is fired.

BACKGROUND

The operating systems used in automatic hunting rifles of the known technique and the technical problems in these systems are as follows;

Gas systems aim to operate by opening the lock by pushing the lever back to the rifle via the piston in the gas chamber by enabling gas passage through the hole or holes which are placed at a certain distance from the barrel. After unlocking, with the mechanism group that is similar in all systems, moves the empty cartridge back, throws the empty cartridge, puts the new full cartridge into the barrel with the effect of the execution spring, at the same time stores the energy required for firing in the main spring and makes the rifle ready for the next shot.

The technical problems experienced in the gas system are the opening of the cartridges of different grams (strength, pressure) at the same point due to the hole in the barrel at a certain distance. Because the hole is located at the same point, the pressure of different cartridges is different at that point. Therefore, the higher pressure created by the stronger cartridges at that point causes the mechanism and the lever block to accelerate backwards more violently and damage the rifle. It causes the system to work hard or not to work with weak cartridges. Although gas evacuation systems were made to eliminate this imbalance in the system, the balance could not be fully achieved. In addition, because of the hole in the barrel, there is a lot of gas escape and its cleaning is more difficult than other systems are the technical problems experienced in this system. However, despite these negativities, it is still the most used system because it works better at lower grams compared to inertial systems.

The inertia (Inertia) system uses the backward acceleration that occurs when the rifle is fired and compresses the thick spring between the lock and the mechanism during the forward movement of the mechanism relative to the rifle with the effect of the inertia force. This spring then throws the mechanism back and opens the lock. Then, with the mechanism group, it moves the empty cartridge back, throws the empty cartridge, puts the new full cartridge into the barrel with the effect of the execution spring and at the same time stores the energy required for firing in the cock spring. Thus, it makes the rifle ready for the next shot.

Although the inertia system works more stable for cartridges of different grams compared to the gas system, it still could not provide equal operation in all cartridges. Because since the cartridges of different strengths cannot squeeze the thick spring that operates the rifle in the same amounts, the operation of the rifle will not be the same. Since it is a very sensitive system, it is very difficult to work with weak cartridges. There is a problem of not working even with medium strength cartridges in cold weather and shots made without good shoulder.

Movable barrel systems are the system found in the first automatic systems in history and have lost their validity because they are worse than the other systems above. The locked barrel is based on pushing the mechanism block back completely. In short-action barrels, although the barrel strikes after a little movement, the lever opens the lock at this speed and moves the empty barrel together with the mechanism group. Then it throws the empty sleeve. It puts the new full cartridge into the barrel with the effect of the execution spring and at the same time stores the energy required for firing in the main spring. Thus, it makes the rifle ready for the next shot. Since these strikes will differ in different cartridges, it makes stable operation impossible. In addition, as it will cause excessive impact in strong cartridges, it causes some parts in the rifle to break, deteriorate and target deviations.

The systems that delay the opening with semi-locking are the use of the system used in some military rifles (such as the g3) in smoothbore military shotguns. Since standard bullets are fired in rifled rifles, delay time is possible. However, it is not possible to set the delay time as a standard for smoothbore shotguns with different strengths. For this reason, the operation of this system in smoothbore shotguns causes serious problems.

SUMMARY

The invention can be explained as an inertia system with pressure control. Thanks to our invention, all problems related to unlocking in automatic smoothbore shotguns, which are fired using cartridges of different strengths in the known technique, are solved. In the gas system, which is one of the most used systems in the known technique, the gas leakage and cleaning problem caused by a hole in the barrel is solved with our invention. As we solved the problem of working hard/not working in weak cartridges in the inertia system, which is the most used system in the known technique, with our invention, we also solved the problem of two rifles not working in the same way in cartridges of different powers, which is the common problem that they work on most. Unlike other systems, the unlocking of the system subject to our invention is provided by the forward movement of the moving part that will unlock the lock when the rifle is locked, rather than the backward movement relative to the rifle. This is the biggest difference from other systems. In addition, another important difference from other systems is the difference in energy gain used to unlock. In gas systems, it takes the energy required to open the lock from the energy provided by the gas coming from the hole in the barrel by pushing the lever back towards the rifle through the piston. The energy required in the inertia system is taken from the inertia caused by the backward acceleration that occurs when the rifle is fired. In the new system subject to our invention, energy is obtained from the kinetic energy of the mechanism and arm block, which is lost by hitting the case after the empty case is thrown. This loss in all systems is as follows. Since the empty cartridge must hit the cartridge at a certain speed in order to be fired from the rifle, the lever block of the mechanism must have the same speed. At this point, a very small part of the energy of the mechanism lever block due to speed is used to throw the empty case, and most of it is lost by hitting the case. This impact also causes an additional impact. This is another situation that shooters do not want. This energy loss is approximately 30-40% of the energy required to operate the rifle. With the system of our invention, we store this lost energy as potential energy on a spring and use it to unlock the next ignition. Since the system subject to our invention opens the lock with this spring force, it also ensures the stable operation of the rifle in cartridges of different strengths.

EQUIVALENTS OF THE NUMBERS GIVEN IN THE FIGURES

Figure 1:
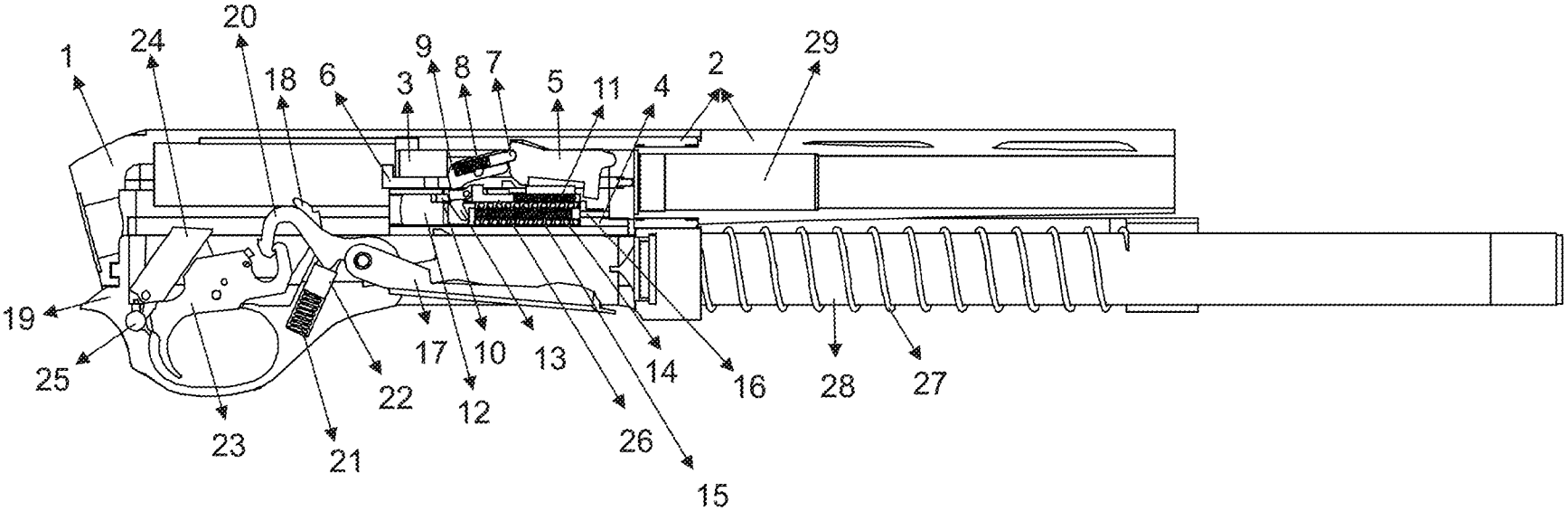
FIG. 1 Sectional View of the System when the Rifle is Ready to Fire
Figure 2:
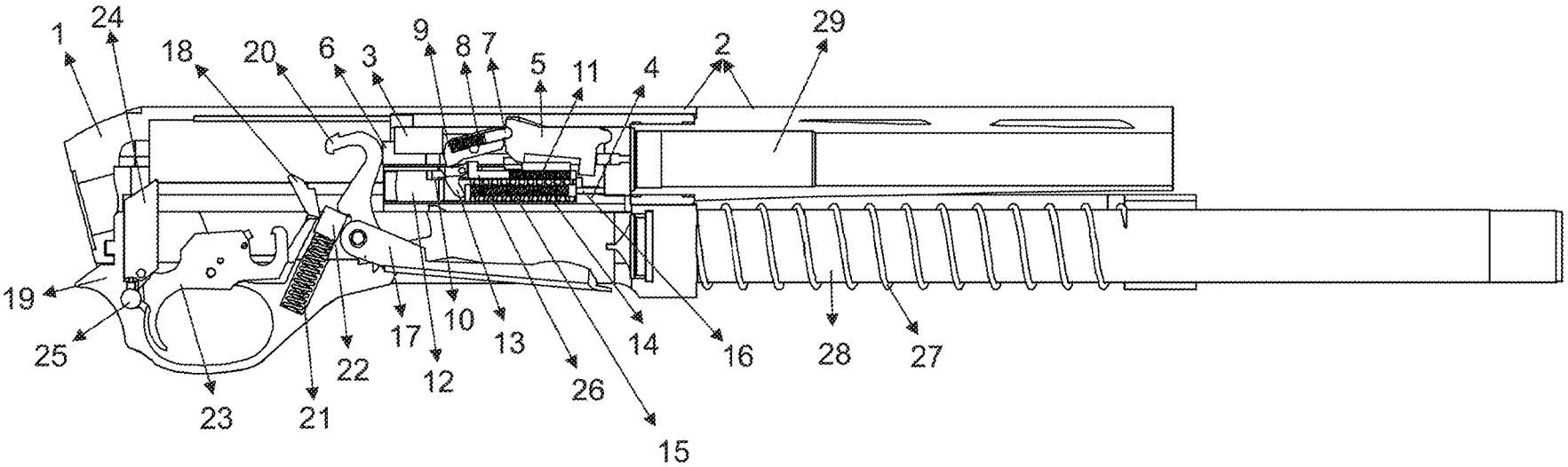
FIG. 2 Sectional View of the System After the Trigger is Pulled
Figure 3:
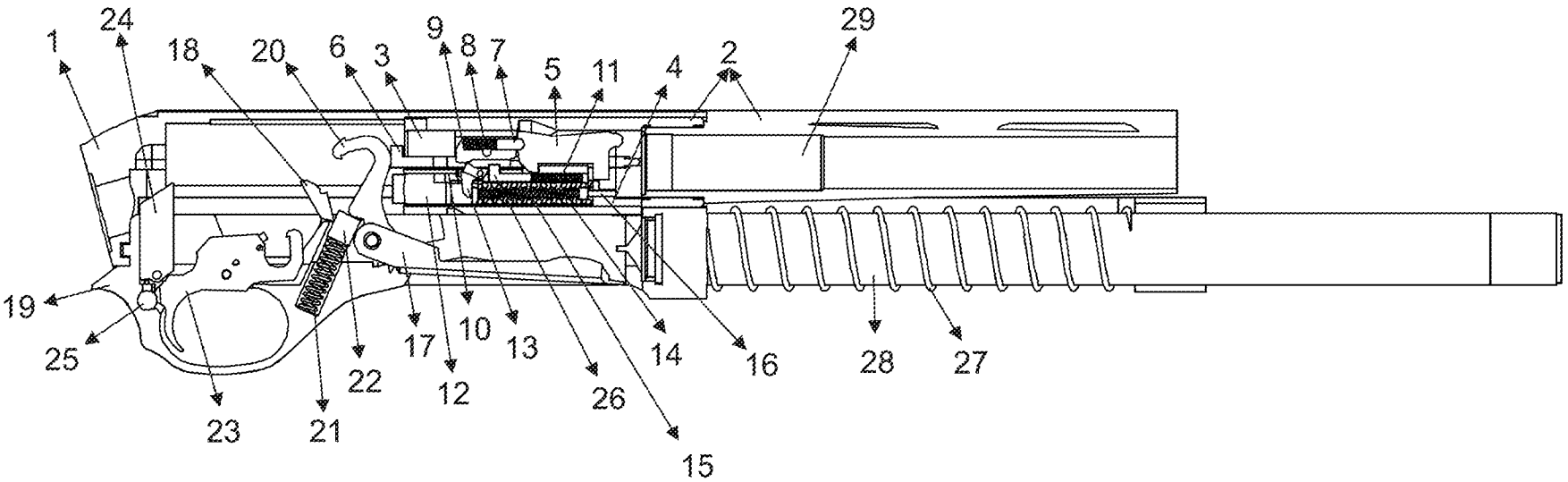
FIG. 3 Sectional View Showing the Forward Movement of the Mechanism and Arm Block with the Effect of Inertia FIG. 4 Sectional View of the System in the Unlocked State FIG. 5 Sectional View Showing the Back Movement of Mechanism and Lever Block FIG. 6 Sectional View Showing the Continuation of the Backward Movement of the Mechanism and Lever Block after the Ejection of the Empty Bucket from the System FIG. 7 Sectional View Showing the Storage of Kinetic Energy by the Energy Storage Spring Generated by Pulling the Trigger FIG. 8 Sectional View Showing the Full Cartridge Taken into the Barrel FIG. 9 Sectional View Showing the Forward Movement of the Mechanism and Arm Block with the Force of the Energy Storage Spring and the Executive Spring FIG. 10 Sectional View Shows the Separation of the Arm from the Mechanism with the Effect of the Distance Spacing Spring and the Making it Ready for Shooting by Locking the Rifle by Entering its Guide in the Cap with the Effect of the Knob Spring FIG. 11 Detail View of the Cross Section of the Lock Mechanism FIG. 12 Detail View of the Cross Section of the Trigger Mechanism
Figure 4:
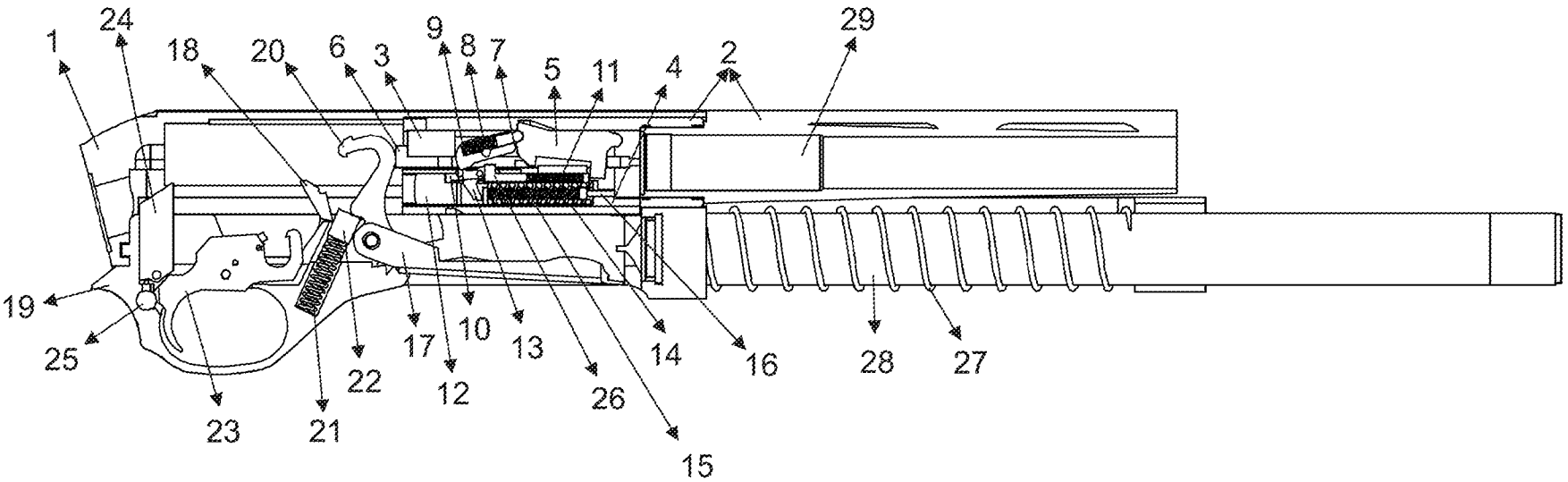
Figure 5:
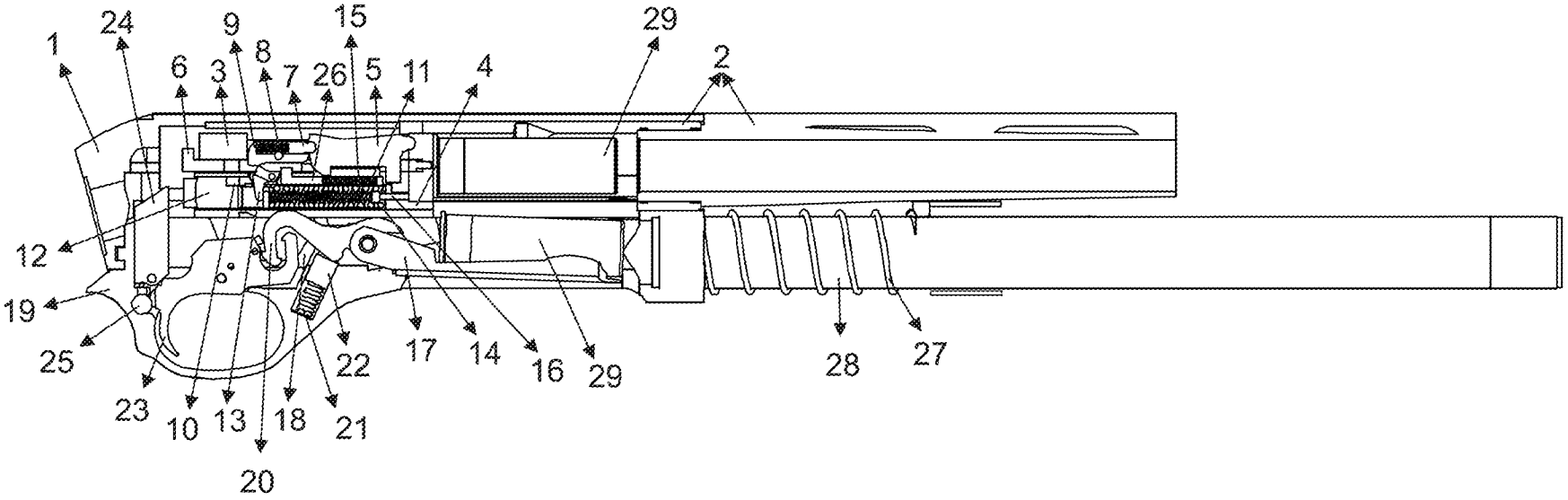
Figure 6:
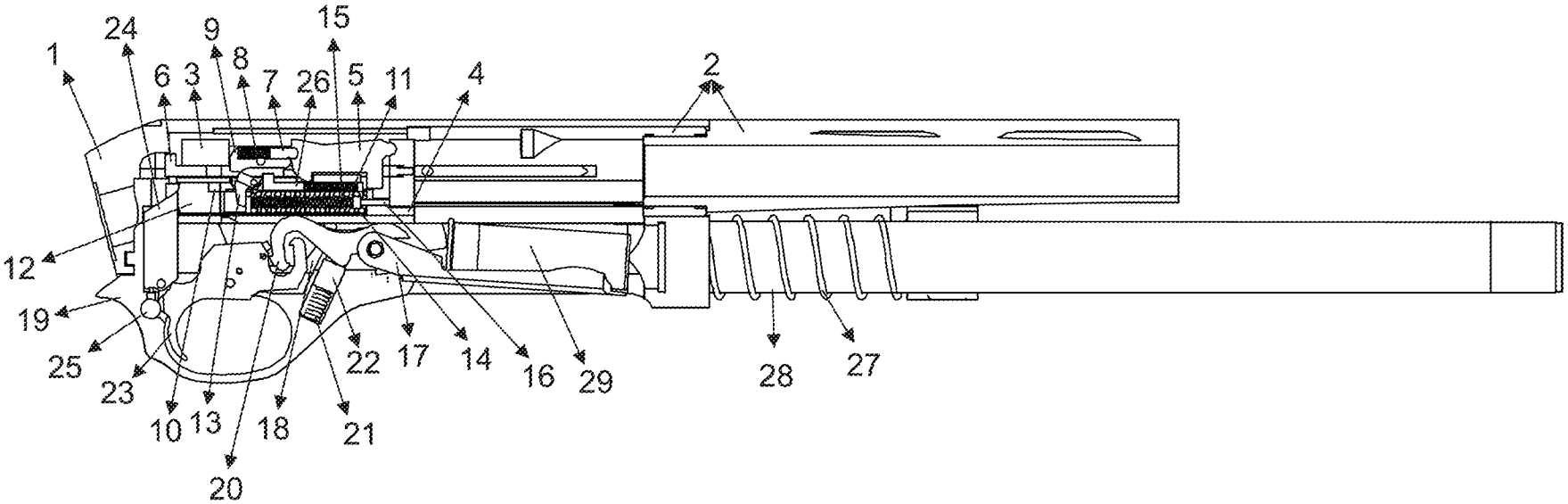
Figure 7:
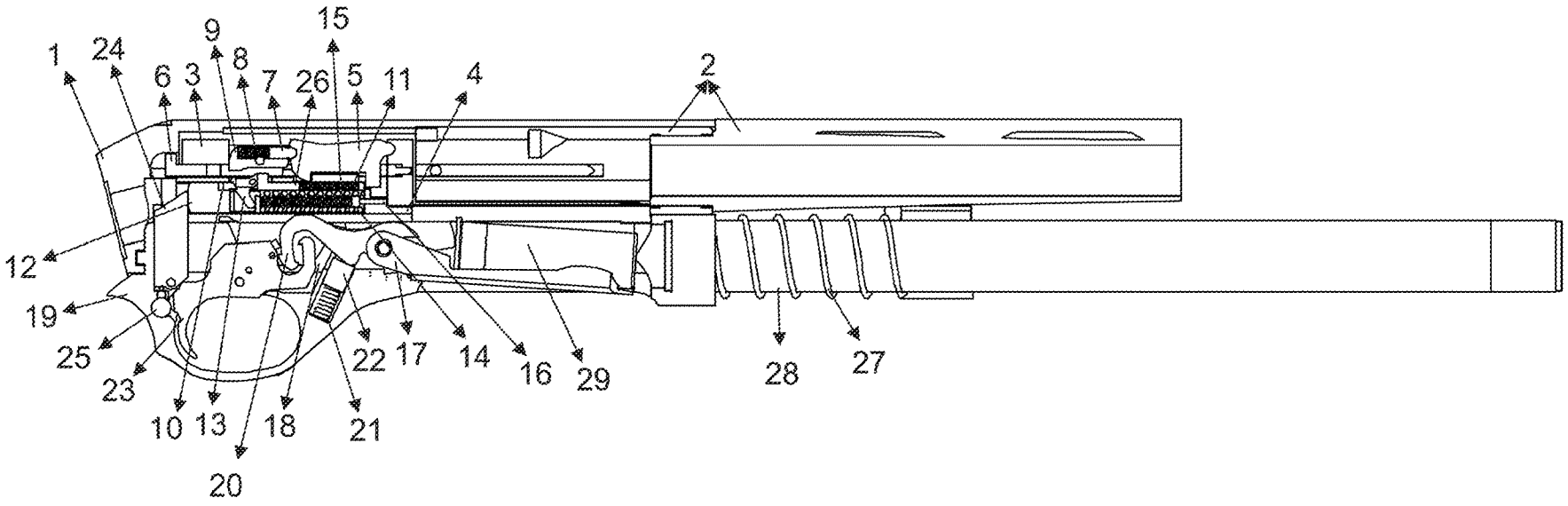
Figure 8:
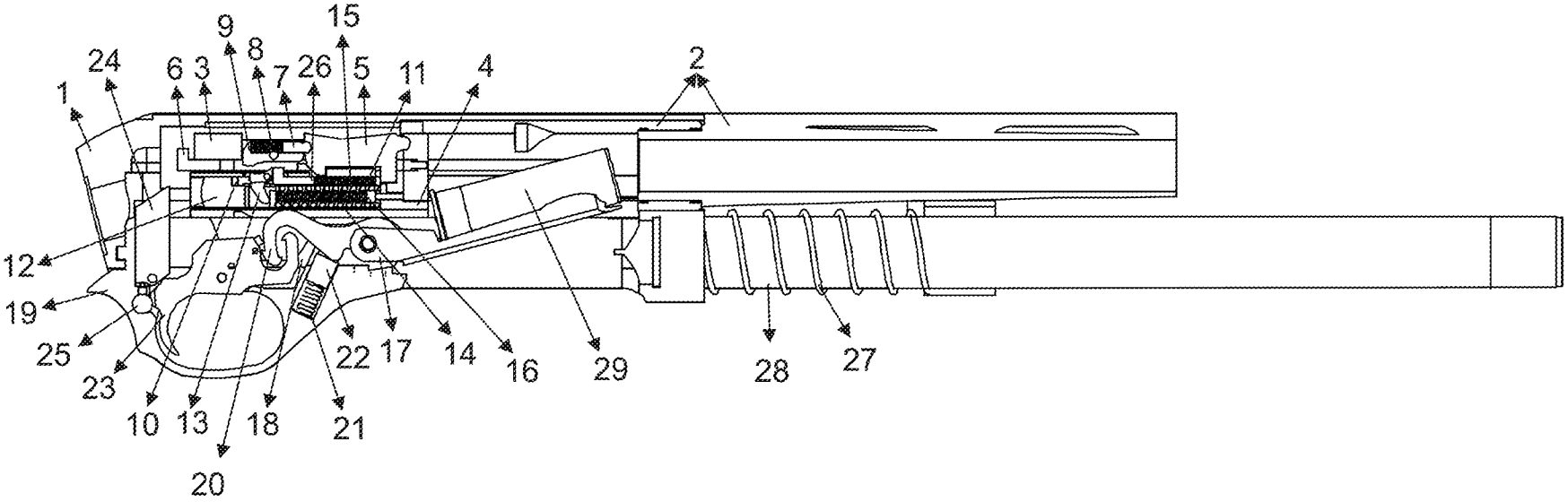
Figure 9:
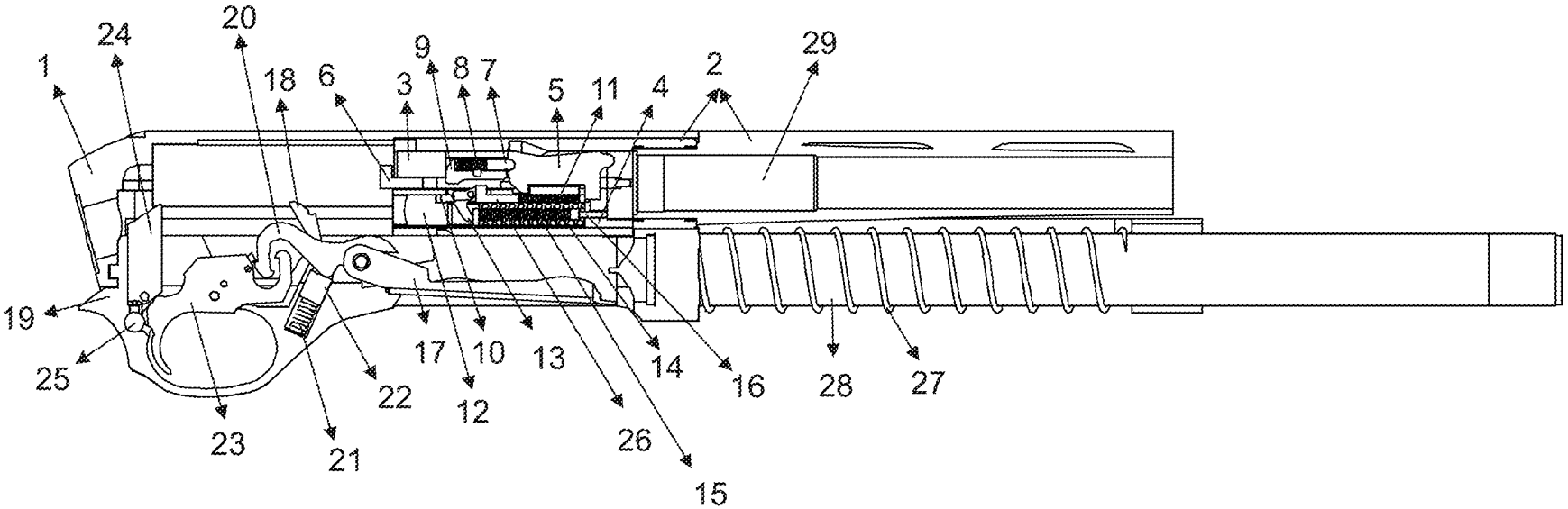
Figure 10:
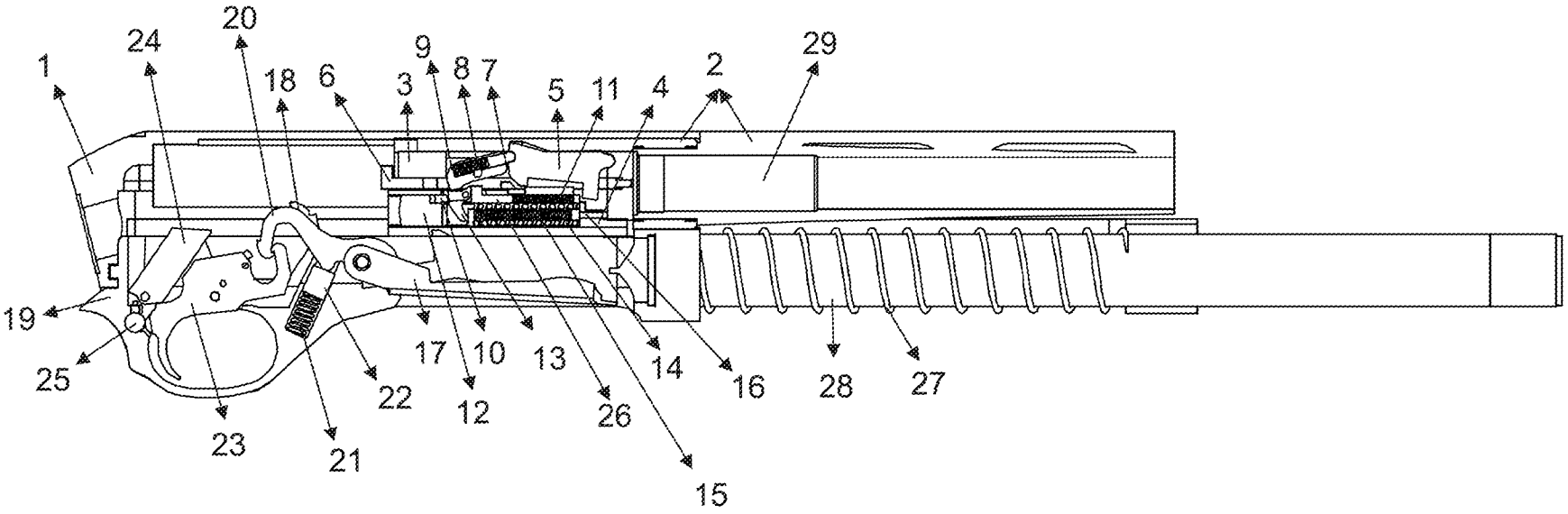
Figure 11:
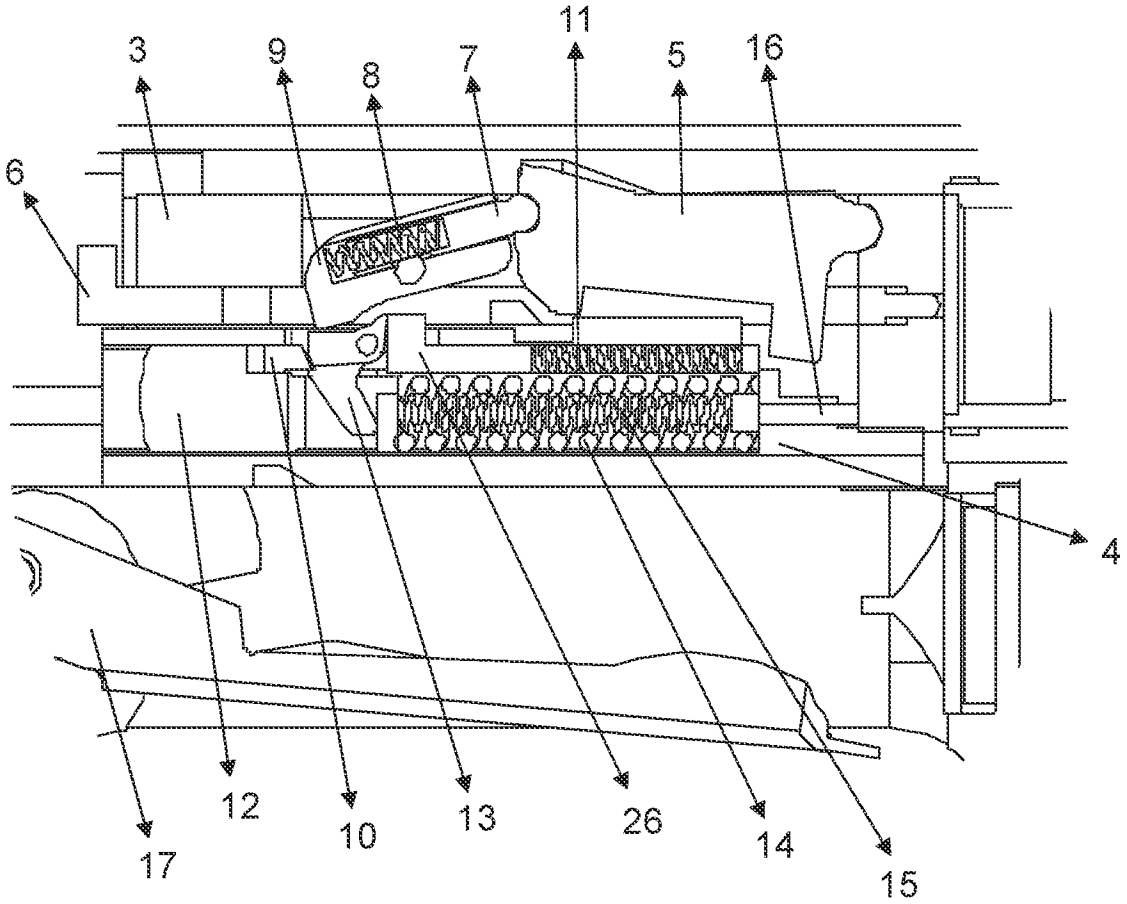
Figure 12:
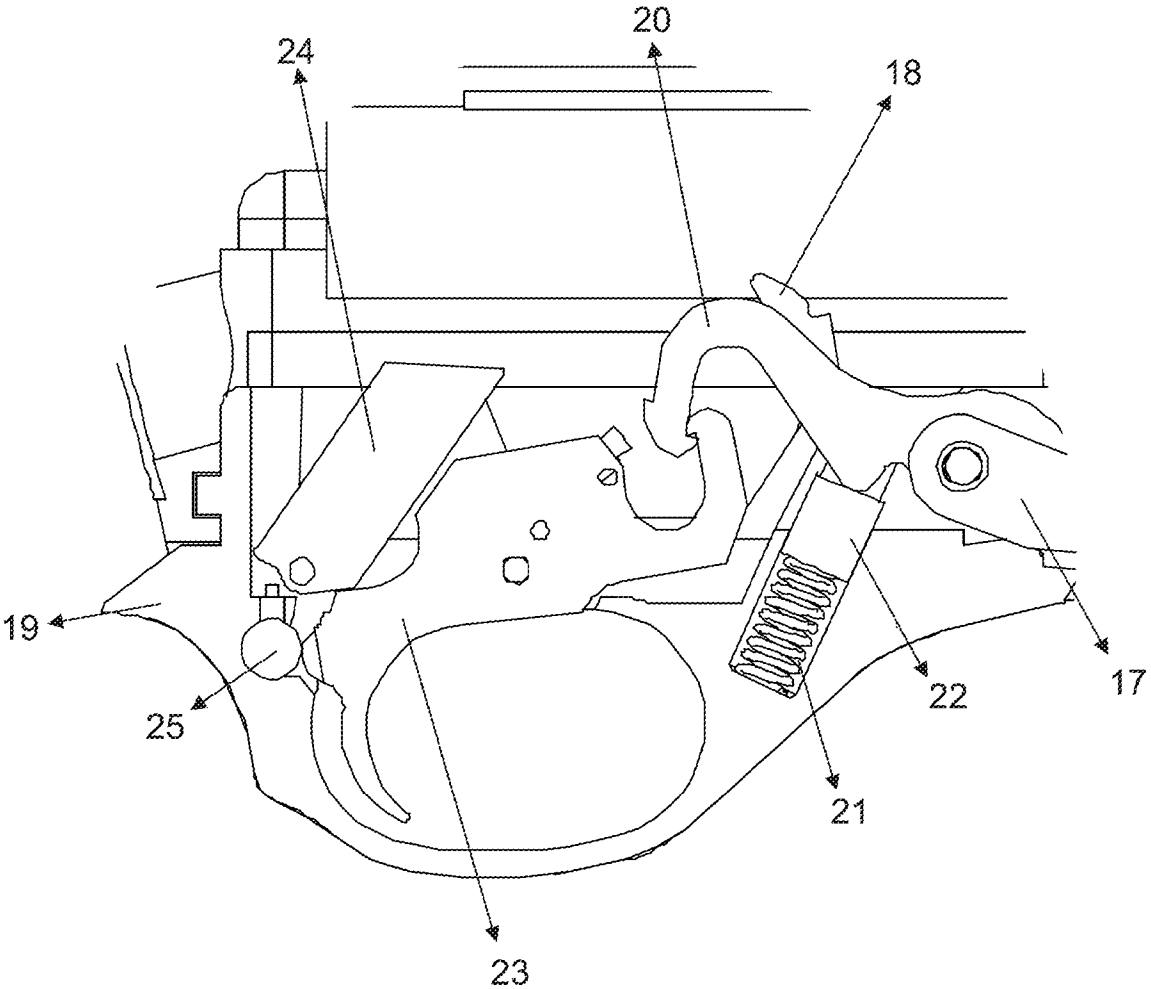

1. Case
2. Cap Barrel
3. Mechanism
4. Sliding Handle
5. Lock
6. Needle
7. Knob
8. Knob Spring
9. Lever
10. Holder
11. Holder Spring
12. Energy Storage Spring Pin
13. Plunger
14. Energy Storage Spring
15. Distance Adjustment Spring
16. Distance Adjustment Pin
17. Spoon
18. Horsehead
19. Guardrail
20. Hammer
21. Hammer Spring
22. Hammer Spring Pin
23. Trigger
24. Spring Setter
25. Safety
26. Plunger Spring Pin
27. Execution Spring
28. Magazine Tube
29. Cartridge

DETAILED DESCRIPTION OF THE EMBODIMENTS

Invention comprises a case (1), a cap barrel (2), a mechanism (3), a sliding handle (4), a lock (5), a needle (6), a knob (7), a knob spring (8), a lever (9), a holder (10), a holder spring (11), an energy storage spring pin (12), a plunger (13), an energy storage spring (14), a distance adjustment spring (15), a distance adjustment pin (16), a spoon (17), a horsehead (18), a guardrail (19), a hammer (20), a hammer spring (21), a hammer spring pin (22), a trigger (23), a spring setter (24), a safety (25), a plunger spring pin (26), an execution spring (27), a magazine tube (28), a cartridge (29).

The casing (1) (e.g., receiver for housing working parts) is the outer body that guides the working parts. The cap barrel (2) (e.g., barrel through which the bullet travels) is the part comprising the barrel with a lock bearing giving direction and speed to the bullet, which does not release the mechanism in the first explosion. Mechanism (3) is the part that comprises parts such as a lock, a needle and a nail. The sliding handle (4) is the movable part that is used to open the rifle when it is locked. The lock (5) is the part that locks the rifle in the first explosion by entering the lock bearing in the cap. The needle (6) is the part that transfers the kinetic energy in the hammer to the capsule in the cartridge and ignites the cartridge. The knob (7) is the part that places the lock in the bearing on the cap with the effect of the knob spring and transfers the force in the lever to the lock and opens the lock. The knob spring (8) is the part that fits the lock into its bearing in the cap. The lever (9) is the piece that transfers the force from the plunger to the lock with the help of the knob (7). The holder (10) is the part that does not release the stored energy in the energy storage spring by entering the bearing in the plunger with the effect of the holder spring. The holder spring (11) is the part that pushes the holder to its bearing in the plunger and also rotates the plunger so that the holder enters the bearing in the plunger while energy is stored. The energy storage spring pin (12) is the part that serves to tighten the energy storage spring when the mechanism and arm strike back. The plunger (13) is the part that transfers the force in the energy storage spring to the lever via the energy storage spring pin. The energy storage spring (14) is the part that stores the wasted energy in the arm and the mechanism after disposing of the empty bucket. The distance adjustment spring (15) is the part that leaves a certain distance between the mechanism and the arm. The distance adjustment pin (16) is the part that leaves a certain distance between the mechanism and the arm. The spoon (17) (e.g., feed ramp) is the part that directs the full cartridge in the magazine to the barrel. The horsehead (18) e.g., feed ramp adjustment mechanism) is the piece that enables the spoon to work properly. The guardrail (19) (e.g., trigger guard) is the body comprises the parts in the trigger group. The cock (20) is the part that transfers the energy of the cock spring to the cartridge via the needle and fires it. The cock spring (21) is the part where the energy to ignite the cartridge is stored. The cock spring pin (22) is the part that ensures the smooth operation of the cock spring. The trigger (23) is the part that releases the energy stored in the hammer spring at the desired time by holding the hammer. The spring setter (24) is the part gets hit by the energy storage spring pin on the arm after throwing the empty sleeve. Safety (25) is the part that makes the trigger active and passive. The plunger spring pin (26) is the part that rotates the plunger so that the holder can enter the bearing in the plunger while energy is stored. The execution spring (27) (e.g., buffer spring) is the part that serves to close the rifle with the mechanism by pushing the lever forward after throwing the empty cartridge. Magazine tube 28 is where full cartridges are stored. The cartridge (29) is the ammunition consisting of the igniter, gunpowder and bullets that enable the firearm to fire. The cartridge (29) is found in the barrel chamber ready to be fired as well as in the magazine to be put into the barrel chamber after the first firing.

The operation of the system can be described as follows with an example scenario. While the rifle is ready to fire, the trigger (23) holds the hammer (20) with the cock spring (21) compressed. The holder (10) holds the plunger (13) while the energy storage spring (14) is compressed. The lock (5) has enters its bearing in the cap (2) with the effect of the knob spring (8). The sliding handle (4) is spaced a certain distance from the mechanism (3) by the effect of the distance adjustment spring (15). When the trigger (23) is pulled, the hammer (20) accelerates with the effect of the hammer spring (21) and hits the needle (6). As a result of this impact, the needle (6) fires the cartridge (29) in the barrel bearing. Then, the high pressure created by the burning of gunpowder, while applying a forward force to the bullet, it also applies a backward force to the mechanism (3). The mechanism (3) applies force to the lock (5), the lock (5) to its bearing in the cap (2), and the cap (2) to the entire rifle. Thus, it accelerates the rifle backwards. During this acceleration, the moving (non-stationary) parts in the rifle also accelerate forward relative to the rifle due to inertia. With the effect of this inertia force, the sliding handle (4) moves forward and closes the gap created by the effect of the distance adjustment spring (15). Meanwhile, the holder (10) releases the stored energy in the energy storage spring by hitting the arm of the lock (5) and freeing the plunger (13) from its grip. Thus, the plunger (13) applies a force to the lever (9), and the lever (9) to the lock (5) through the knob (7) in the direction of opening the lock (5). However, the lock (5) is not opened immediately, because the pressure in the barrel, which we mentioned above, exerts a force against the mechanism (3), the mechanism (3) to the lock (5), the lock (5) to the cap (2), thus a friction force occurs. This friction force is directly proportional to the gas pressure inside the barrel. Gas pressure in the barrel also decreases inversely with the position of the bullet in the barrel after the maximum gas pressure point that occurs after the gunpowder is completely burned. For example, let's assume that the gas pressure reaches its maximum level when the bullet moves 10 cm through the barrel. After that, the advancement of the bullet in the barrel lowers the pressure. When the bullet reaches 20 cm, the gas pressure drops to half of the maximum gas pressure. The friction force between the lock (5) and the cap (2) decreases as the pressure decreases as the bullet moves through the barrel. When the gas pressure drops to the most appropriate level required for the rifle to operate, regardless of which cartridge is fired at different forces, the force of the energy storage spring (14) overcomes the friction force and opens the lock (5). Then, with the effect of the pressure falling to the optimum level required for the rifle to operate, the mechanism (3) sliding handle (4) block is pushed back. While this block is moving backwards, the fired empty cartridge (29) is also pulled. With the mechanism (3) sliding handle (4) block pushing the hammer (20), the cock spring (21) is compressed and the energy required to detonate the cartridge (29) is stored. In addition, the full cartridge (29) in the magazine tube (28) is released backwards with the effect of the magazine spring. The empty cartridge (29) is thrown out of the window in the casing (1) with the help of the notch, with the hit of the empty cartridge to the empty cartridge thrower in the cap (2) with a certain speed. After this moment, the mechanism (3) sliding handle (4) block continues to its movement backwards and hits the spring setter (24), which gets active by pulling the trigger (23), that is, the position necessary for the energy storage spring pin (12) to hit. The kinetic energy of the mechanism (3) sliding handle (4) block is absorbed by the energy storage spring (14) through the energy storage spring pin (12). The holder (10) enters the notch in the plunger (13) with the effect of the holder spring (11) and stores this energy absorbed by the energy storage spring (14) by preventing it from escaping. Then, this mechanism (3) sliding handle (4) block, which completes its backward movement, accelerates forward with the effect of the execution spring (27). During this movement, the mechanism (3) sliding handle (4) block continues on its way by taking the full cartridge (29) directed by the spoon (17) towards the barrel with the help of the horsehead (18). Then it hits the cap (2) and stops. Subsequently, the sliding handle (4) is spaced from the mechanism (3) by the effect of the distance adjustment spring (15). The lock (5) enters its bearing in the cap (2) under the effect of the knob spring (8) and locks the rifle and makes it ready to fire again. The system works with cartridges of all weight without any problem with this cycle.

If we write the operation of the system step by step;

When the trigger (23) is pulled at a certain distance from the mechanism (3), the hammer (20) accelerates and hits the needle (6) with the effect of the cock spring (21) (This is a stage in the known technique)

the needle (6) fires the cartridge (29) in the barrel bearing as a result of this impact (This is a stage in the known technique)

Then, the high pressure created by the combustion of gunpowder, while applying a forward force to the bullet, applying a backward force to the mechanism (3) (This is a stage in the known technique), The mechanism (3) applies a force to the lock (5), the lock (5) applies a force to its bearing in the cap (2) which it is entered, and the cap (2) applies a force to the complete rifle (This is a stage in the known technique), Thus, the rifle is accelerated backwards (This is a stage in the known technique), The sliding handle (4) moves forward with the effect of the inertia force and closes the gap caused by the effect of the distance adjustment spring (15), In the meantime, the holder (10) releases the stored energy in the energy storage spring by hitting the arm of the lock (5), freeing the plunger (13) from its grip, Thus, the plunger (13) applies a force to the lever (9), and the lever (9) to the lock (5) through the knob (7) in the direction of opening the lock (5), Preventing the lock (5) from opening immediately due to the friction force between these parts due to the force applied by the pressure inside the barrel to the mechanism (3), the mechanism (3) to the lock (5), the lock (5) to the cap (2), The friction force between the lock (5) and the cap (2) decreases together with the pressure that decreases as the bullet moves in the barrel, The force of the energy storage spring (14) overcomes the friction force and opens the lock (5) when the gas pressure drops to the optimum level required for the rifle to operate, regardless of which cartridge is fired at different forces, Then, with the effect of the pressure falling to the optimum level required for the rifle to operate, the mechanism (3) sliding handle (4) block is pushed backward, While this block is coming backwards, pulling the fired empty cartridge (29) (This is a step in the Known Technique), Storing the energy required to fire the cartridge (29) by compressing the cock spring (21) by pushing the cock (20) of the mechanism (3) sliding handle (4) block (This is a stage in the Known Technique), In addition, the full cartridge (29) in the magazine tube (28) is also released backwards with the effect of the magazine spring (This is a stage in the Known Technique), The empty cartridge (29) is thrown out of the window in the casing (1) with the help of the notch by hitting the empty cartridge thrower in the cap (2) with a certain speed (This is a stage in the Known Technique), After this moment, the mechanism (3) sliding handle (4) block continues to move backwards and hits the spring setter (24), which is active by pulling the trigger (23), that is, the position required to hit the energy storage spring pin (12), The kinetic energy of the mechanism (3) sliding handle (4) block is absorbed by the energy storage spring (14) by the energy storage spring pin (12), The holder (10) enters the notch in the plunger (13) with the effect of the holder spring (11), and stores this energy absorbed by the energy storage spring (14) by preventing it from escaping, Then, the mechanism (3) sliding handle (4) block, which completes its backward movement, accelerates forward with the effect of the executive spring (27) (This is a stage in the Known Technique), During this movement of the mechanism (3) sliding handle (4) block, the spoon (17) continues on its way by taking the full cartridge (29) directed towards the barrel with the help of the horsehead (18) (This is a stage in the Known Technique), Then stopping by hitting the cap (2) (This is a stage in the Known Technique), Subsequently, the sliding handle (4) is spaced from the mechanism (3) by the effect of the distance adjustment spring (15), The lock (5), by the effect of the knob spring (8), enters its bed in the cap (2) and locks the rifle and makes the rifle ready for a new firing.

What is claimed is:

1. A method of operating a pressure controlled inertia system for automatic fire weapons comprising the following steps:

moving a sliding handle forward by an inertia force, wherein a holder causes a release of a stored energy from an energy storage spring when a lock is contacted and a plunger is freed from contact with the holder, wherein a force of the energy storage spring overcomes a friction force and opens the lock when a gas pressure drops to an optimum level required for a rifle to operate regardless of a cartridge fired at different forces, pushing a mechanism and the sliding handle backward when the gas pressure falls to the optimum level required for the rifle to operate until a spring setter is contacted, wherein the spring setter is activated by pulling a trigger to a position until an energy storage spring pin is contacted, wherein a kinetic energy of the mechanism and the sliding handle is absorbed by an energy storage spring through the energy storage spring pin, wherein a holder spring causes the holder to contact the plunger and store an energy absorbed by the energy storage spring preventing the energy from escaping, wherein the sliding handle is spaced from the mechanism by the distance adjustment spring, wherein a knob spring causes the lock to enter a cap barrel and lock the rifle to make the rifle ready for a new firing.

* * * * *